US012564252B2

(12) United States Patent
Carol

(10) Patent No.: US 12,564,252 B2
(45) Date of Patent: Mar. 3, 2026

(54) PORTABLE HANGING KNITTING NEEDLE AND ACCESSORY HOLDER

(71) Applicant: Paula Carol, Huntington, NY (US)

(72) Inventor: Paula Carol, Huntington, NY (US)

( * ) Notice: Subject to any disclaimer, the term of this patent is extended or adjusted under 35 U.S.C. 154(b) by 0 days.

(21) Appl. No.: 18/787,008

(22) Filed: Jul. 29, 2024

(65) Prior Publication Data

US 2026/0026591 A1 Jan. 29, 2026

(51) Int. Cl.

| | |
|---|---|
| ***A47F 5/00*** | (2006.01) |
| ***A45C 11/26*** | (2006.01) |
| ***A45C 13/10*** | (2006.01) |
| ***B65D 85/24*** | (2006.01) |

(52) U.S. Cl.

CPC ..... *A45C 11/26* (2013.01); *A45C 13/103* (2013.01); *A45C 2013/1015* (2013.01); *A45C 2200/10* (2013.01); *B65D 85/24* (2013.01)

(58) Field of Classification Search

CPC ..... A45C 11/26; A45C 13/103; A45C 2013/1015; A45C 2200/10; A45C 7/0095; A45C 2003/008; A45C 2007/0004; A45C 3/12; A45F 3/48; A47G 29/00; A47G 29/08; A47G 29/087; A47G 25/005; B65D 85/24

USPC ..... 206/575, 380; 211/113, 118

See application file for complete search history.

(56) References Cited

U.S. PATENT DOCUMENTS

| | | | | | |
|---|---|---|---|---|---|
| 1,495,220 | A * | 5/1924 | Carroll | A45C 3/00 | 383/66 |
| 2,359,372 | A * | 10/1944 | Leader | A47G 25/005 | 211/35 |
| D154,993 | S * | 8/1949 | Crothers | D6/553 | |
| 2,532,517 | A * | 12/1950 | Schwartzman | A47G 25/005 | 383/39 |
| 2,545,611 | A * | 3/1951 | Flannery | D04B 3/00 | 206/380 |
| 2,628,711 | A * | 2/1953 | Flannery | D04B 3/00 | 206/382 |
| 3,120,297 | A * | 2/1964 | Riley | A45C 7/0095 | 190/110 |
| 3,181,751 | A * | 5/1965 | Wilson | A45F 5/00 | 224/920 |
| 3,749,233 | A * | 7/1973 | McCormick, Jr. | A45C 11/26 | 312/902 |
| D275,150 | S * | 8/1984 | Haws | D3/23 | |
| 4,478,333 | A * | 10/1984 | Dalbo | A45F 3/48 | 223/109 R |

(Continued)

*Primary Examiner* — Gideon R Weinerth
(74) *Attorney, Agent, or Firm* — John F. Vodopia

(57) ABSTRACT

A storage device for storing and displaying knitting supplies has a vinyl backing, first, second and third rows of pockets formed from planar, substantially rectangular portions of pocket material attached to the vinyl backing at 3 of 4 edges of the planar, substantially rectangular portions thereby forming an opening, an edge trim arranged at respective edges of the planar, substantially rectangular portions of the first, second and third rows of pockets to support installing and or securing the storage device. The second and third rows of pockets are substantially similar. Edge trim arranged at respective edges of the planar, substantially rectangular portions supports installing and or securing the storage device. An accessory pouch detachably attached to edge trim proximate a bottom edge of the third row of pockets.

16 Claims, 4 Drawing Sheets

(56) References Cited

U.S. PATENT DOCUMENTS 4,715,499 A * 12/1987 Franklin ..... A45C 11/26 206/459.5
D300,399 S * 3/1989 Krugman ..... D6/514
4,846,351 A * 7/1989 Gardiner ..... D04B 3/00 66/118
4,859,084 A * 8/1989 Kaumeyer ..... A45C 3/00 383/22
4,901,899 A * 2/1990 Barrett ..... A45C 7/0095 294/146
4,949,843 A * 8/1990 Stokes ..... A47F 7/146 383/38
5,125,519 A * 6/1992 Cambria ..... A45C 3/02 211/113
D332,697 S * 1/1993 Schildkraut ..... D3/903
5,562,204 A * 10/1996 Sapyta ..... A45C 7/0054 190/110
5,779,033 A * 7/1998 Roegner ..... A45C 7/0095 206/6.1
5,813,539 A * 9/1998 DePalma ..... G09D 3/04 40/107
D429,897 S * 8/2000 Rogman ..... D6/571
D438,412 S * 3/2001 Dolan ..... D6/513
6,467,613 B2 * 10/2002 Felsenthal ..... A47G 29/00 383/39
D500,919 S * 1/2005 MacKay ..... D3/20
7,028,870 B2 * 4/2006 Valdez-Campbell ..... A45C 7/0095 224/684
D543,760 S * 6/2007 Utzinger, III ..... D6/553
D595,918 S * 7/2009 Walter ..... D34/27
8,028,833 B1 * 10/2011 Clark ..... A45D 40/24 206/385
8,915,354 B1 * 12/2014 Smith ..... A45C 11/26 206/495
9,287,107 B2 * 3/2016 Powell ..... H01K 3/305
D761,588 S * 7/2016 Cohen ..... D6/553
10,561,215 B1 * 2/2020 Klein ..... A45C 13/02
10,568,421 B2 * 2/2020 Felsenthal ..... A47G 29/087
D881,988 S * 4/2020 Fu ..... D19/105
D885,081 S * 5/2020 Baul ..... D6/553
10,856,657 B2 * 12/2020 Felsenthal ..... A47B 61/04
10,940,991 B2 * 3/2021 Elalouf ..... A45C 11/24
D917,200 S * 4/2021 Zeng ..... D6/553
11,319,652 B2 * 5/2022 Carol ..... D04B 3/06
12,239,194 B1 * 3/2025 Marshall ..... A45C 11/26
2002/0071618 A1 * 6/2002 Felsenthal ..... A01M 1/2055 206/286
2003/0164345 A1 * 9/2003 Jones ..... A47J 47/16 211/118
2004/0182664 A1 * 9/2004 Milionta ..... A01K 97/06 190/110
2005/0230336 A1 * 10/2005 Mundy ..... A47B 81/00 211/113
2006/0207956 A1 * 9/2006 Sivers ..... A47G 29/00 211/113
2011/0297569 A1 * 12/2011 Carol ..... B65D 85/24 206/383
2013/0220956 A1 * 8/2013 Carr ..... A47G 25/743 211/113
2014/0225619 A1 * 8/2014 Powell ..... H01K 3/32 324/403
2015/0122672 A1 * 5/2015 Bouton-MacLaughlin ..... A45C 7/0086 493/243
2018/0317647 A1 * 11/2018 Felsenthal ..... A47B 95/00
2018/0319578 A1 * 11/2018 Elalouf ..... A45C 13/02
2019/0021463 A1 * 1/2019 Oja ..... A61M 16/0465
2022/0015517 A1 * 1/2022 Spencer ..... A45C 13/103
2022/0256998 A1 * 8/2022 Hoffmann ..... A45F 3/02
2024/0156228 A1 * 5/2024 Herndon ..... A45C 15/00

* cited by examiner

PORTABLE HANGING KNITTING NEEDLE AND ACCESSORY HOLDER

BACKGROUND OF THE INVENTION

The present invention relates to storage devices and, more particularly, to a portable storage device for holding knitting needles and related accessories.

Seasoned knitters often face a problem with clutter in the storage and retrieval of knitting needles and supplies. For example, knitters have many varying sizes of needles. These varying sized needles may be difficult to find by knitters when needed. Conventional storage devices may not allow the user to view all of their knitting tools in one area without looking into various containers or separate storage bags.

As can be seen, there is a need for an apparatus for organizing and storing knitting needles and supplies.

SUMMARY OF THE INVENTION

In one aspect of the present invention, a storage device comprises multiple rows of pockets including at least a first row of elongated pockets and a first row of large pockets; a plurality of grommets located along a top edge of the storage device, wherein the elongated pockets and the large pockets are transparent or translucent, allowing a user to see the items stored within the pockets.

In another aspect of the present invention, a storage device comprises multiple rows of transparent pockets including at least a first row of elongated pockets, a second row of elongated pockets positioned below the first row of elongated pockets, and a first row of large pockets positioned below the second row of elongated pockets; and a plurality of grommets located along a top edge of the storage device, wherein the elongated pockets and the large pockets are transparent or translucent, allowing a user to see the items stored within the pockets; the first row of elongated pockets and the second row of elongated pockets each include from about 8 to about 10 pockets; the first row of elongated pockets and the second row of elongated pockets are independently from about 1 to 3 inches wide and from about 16 to about 20 inches high; and the first row of large pockets include three equally sized pockets.

In an embodiment, the invention provides a storage device for storing and displaying knitting supplies that includes a a vinyl backing, first, second and third rows of pockets formed from planar, substantially rectangular portions of pocket material attached to the vinyl backing at 3 of 4 edges of the planar, substantially rectangular portions thereby forming an opening at a fourth that is not attached to the vinyl backing, wherein the first row of pockets provides for storing and displaying knitting needles and wherein the second and third rows of pockets are substantially similar and provide for storing and displaying knitting materials.

The inventive storage device includes an edge trim arranged at respective edges of the planar, substantially rectangular portions of the first, second and third rows of pockets, which edge trim supports installing and or securing the storage device; a plurality of grommets arranged in the trim proximate a top edge of the vinyl backing; and an accessory pouch detachably attached to edge trim proximate a bottom edge of the third row of pockets. The planar, substantially rectangular portions of pocket material attached to the vinyl backing at 3 of 4 edges are transparent or translucent. The planar, substantially rectangular portions of pocket material include a pocket trim located at a fourth of the 4 edges of the pocket material, which fourth of the 4 edges is not attached to the vinyl backing to operate as a pocket opening, to support knitting needles stored and displayed therein.

The accessory pouch is attached with a means for attaching, which means for attaching comprises grommets to which the accessory pouch attaches. The pockets of the first row of pockets include from about 8 to about 10 pockets. The pockets of the first row of pockets includes 9 pockets. The pockets of the first row of pockets are about preferably 1 inch to about 4 inches wide and from about 10 to about 16 in depth. The pockets of the first row of pockets are any of 2.75 inches, 1.5 inches and 3.75 inches in width and 13.5 inches in depth. The pockets of the second and third row of pockets are about 8 inches to about 12 inches in depth and about 6 inches to 10 inches in width. The pockets of the second and third row of pockets are about 10 inches in depth and about 8 inches in width.

The accessory pouch is between about 10 inches and 14 inches in depth and about 10 inches to 18 inches in width. The accessory pouch is about 12 inches and 16 inches in width. The planar material comprising the accessory pouch is clear plastic or vinyl and includes Velcro or a zipper to close the accessory pouch. The plurality of grommets includes four grommets equally spaced along the top edge of the storage device. The invention can include trim material separating the pockets and separating the pockets from an accessory pouch. The storage device of claim 14, wherein a bottom edge of the accessory pouch is fortified by a 1-inch vinyl band or an EVA band.

The invention also provides a storage device for storing and displaying knitting supplies. The storage device consists of multiple rows of transparent pockets including at least a first row of elongated pockets for storing and displaying knitting needles, a second row of elongated pockets for storing and displaying knitting needles positioned below the first row of elongated pockets, and a first row of large pockets for storing and displaying knitting materials positioned below the second row of elongated pockets. A top edge and a bottom edge of the storage device formed with top and bottom device trims comprising a trim material. A plurality of grommets located along the top and bottom device trims comprising the top edge and the bottom edge of the storage device providing capabilities to easily install and to secure the storage device, respectively.

An accessory pouch attached to a binding or trim material that binds the accessory pouch to a lowest row; the first row of elongated pockets and the second row of elongated pockets each include from about 8 to about 10 elongated pockets; each of the elongated pockets is configured with a pocket edge trim on an exterior edge of a transparent or translucent material forming the elongated pockets providing a capability to support knitting needles stored and displayed therein. The first row of elongated pockets and the second row of elongated pockets are independently from about 1 to 3 inches wide and from about 16 to about 20 inches high. The first row of large pockets includes three equally sized pockets. The the accessory pouch preferably is about 12 inches in depth and 16 inches in width.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a storage device that may be portable and may be configured to be hung on a wall or a door, for example. The storage device may include a plurality of pockets made of a transparent or translucent material through which a user may see the items stored in the pockets.

The pockets may be formed in various sizes suitable for holding knitting needles and accessories. By displaying individual knitting needles in the pockets, a person can easily eye his or her needles and accessories and keep all of the items in one place for handy access.

Figure 1:
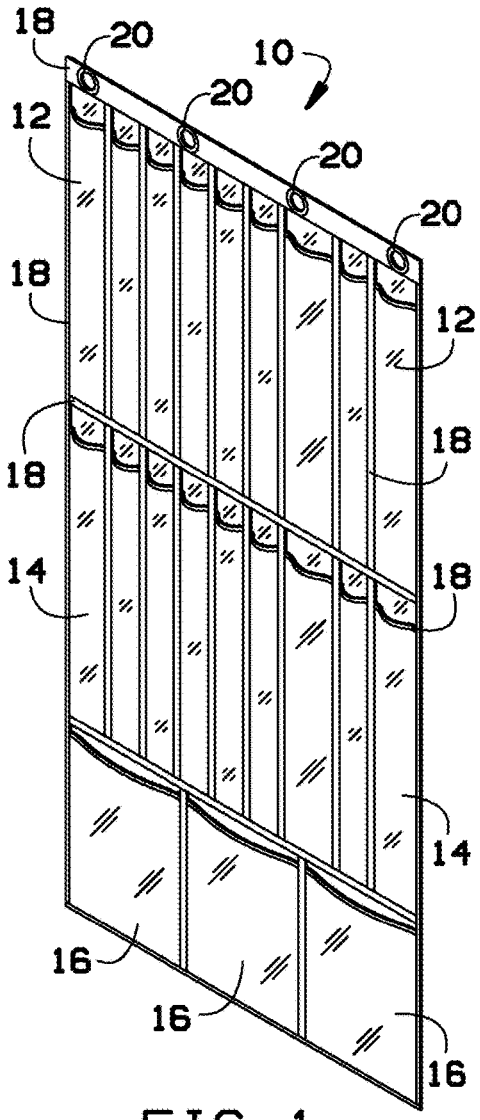
FIG. 1 is a perspective view of a storage device according to an embodiment of the present invention.
Figure 2:
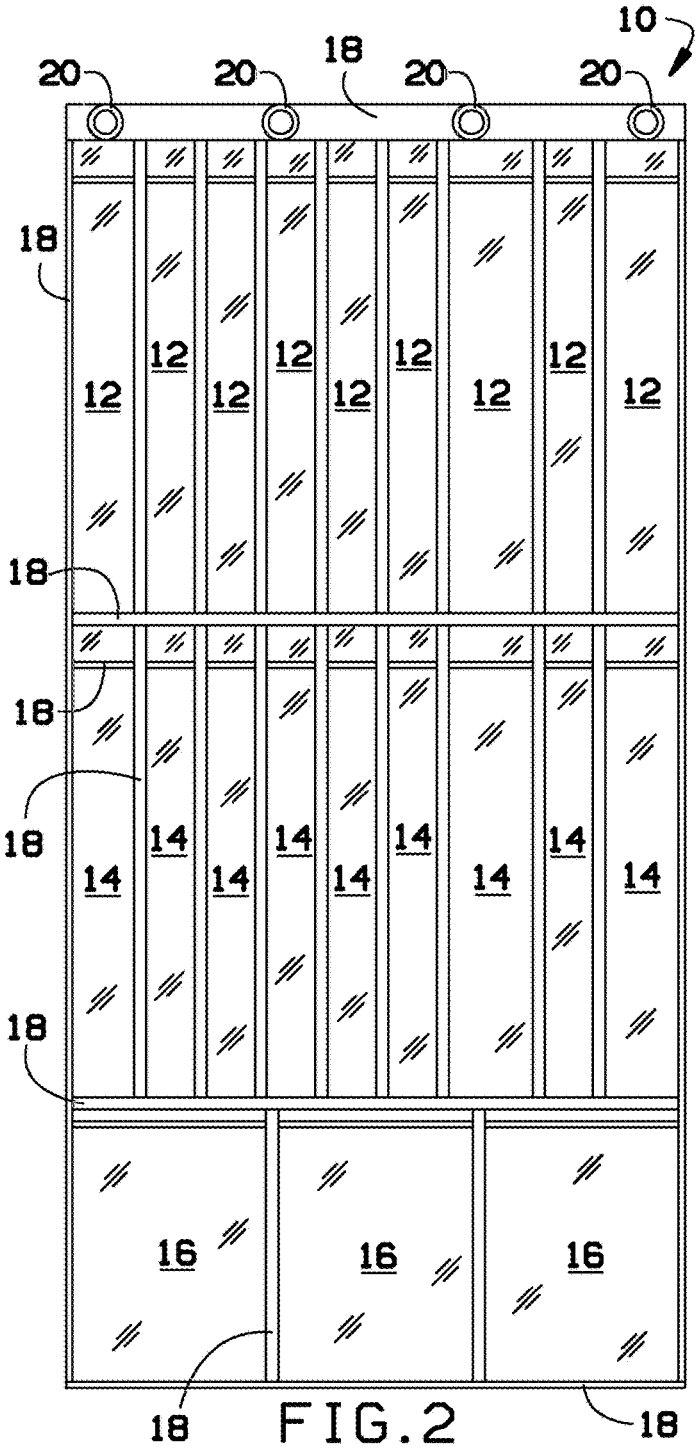
FIG. 2 is a front view of the storage device of FIG. 1.
Figure 3:
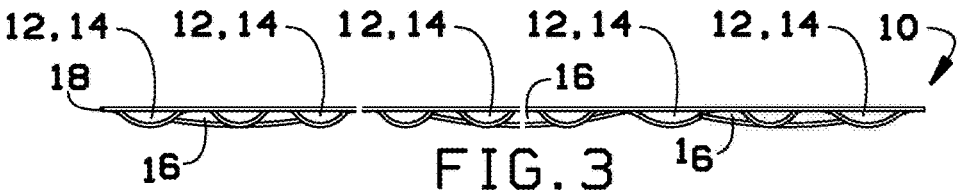
FIG. 3 is a top view of the storage device of FIG. 1.

Referring to FIGS. 1 through 3, a storage device 10 may include a plurality of pockets 12, 14, 16 formed of a transparent or a translucent material. The material is fixed to a backing, which may be white (but not limited to white), which is seen when viewing a transparent pocket through the transparent material. For example, see how the pocket trim and the pocket material 12 in FIG. 1 extends out from the plane of the backing to form the pocket 12 (as well as pockets 14 and 16).

The material may be, for example, a clear heavy duty vinyl. The pockets 12, 14, 16 may be separated by a trim 18. The trim 18 may be, for example, black, clear or a variety of colors. A plurality of grommets 20 may be installed at one end of the storage device 10. For example, four two-inch grommets 20 may be equally spaced about the top edge of the storage device 10. The grommets 20 may be used for easy installation of the storage device 10 and may allow for portability of the storage device 10. In an alternate embodiment, over-the-door hooks may be either attached directly to the storage device 10 or may be used to provide a hook for the grommets 20.

Figure 5:
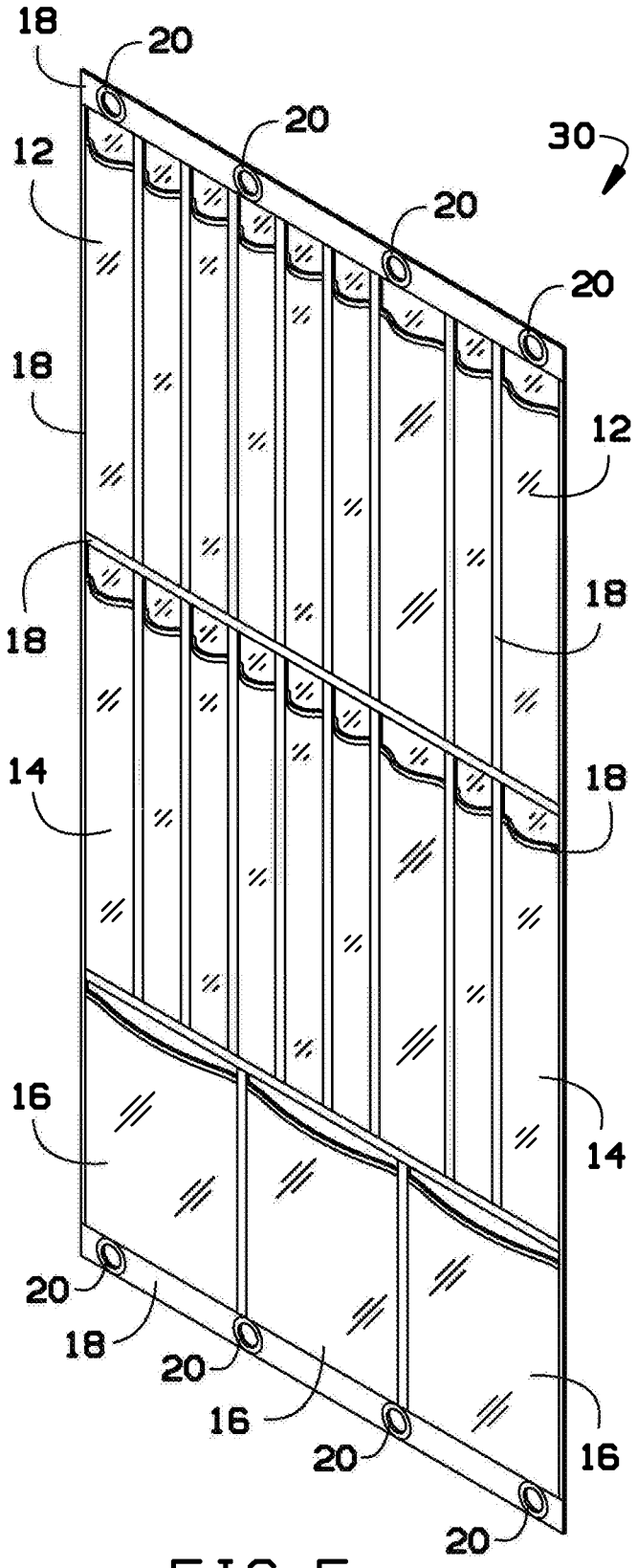
FIG. 5 is a perspective view of the storage device of FIG. 1 with the addition of bottom grommets, according to an embodiment of the present invention.

In a further alternate embodiment of the present invention as shown in FIG. 5, in a storage device 30, grommets 20 may be disposed along a bottom edge of the storage device. The bottom grommets may help secure the storage device to a door, for example, to prevent the bottom of the storage device from swing away from the door as the door is opened or closed.

The storage device 10 may be from about 20 to about 30 inches wide, typically about 24-26 inches wide. The storage device 10 may be from about 45 to about 60 inches high, typically about 52-54 inches high.

In one embodiment of the present invention, a first row of pockets 12 and a second row of pockets 14 (elongated pockets 12, 14) each may include from about 5 to about 15 pockets, typically about 8 to about 10 pockets. The pockets 12, 14 may have depths from about 14 to about 24 inches, typically from about 16 to about 20 inches. The pockets 12, 14 may have various widths, ranging, for example, from about 1 inch to about 3 inches, typically from about 1⅜ inch to about 2⅜ inch. The pockets 12 may be separated from the pockets 14 by about one inch.

A third row of pockets 16 (large pockets 16) may be formed along the bottom of the storage device 10. The third row of pockets 16 may be formed from about 7 to about 9 inches wide and from about 10 to about 12 inches high. In one embodiment, the third row of pockets 16 may include three equal sized pockets 16. Similar to the other pockets 12, 14, the pockets 16 may be formed from a transparent or translucent material, such as a clear vinyl material. The pockets 16 may be separated from the pockets 14 by about one inch.

Figure 4:
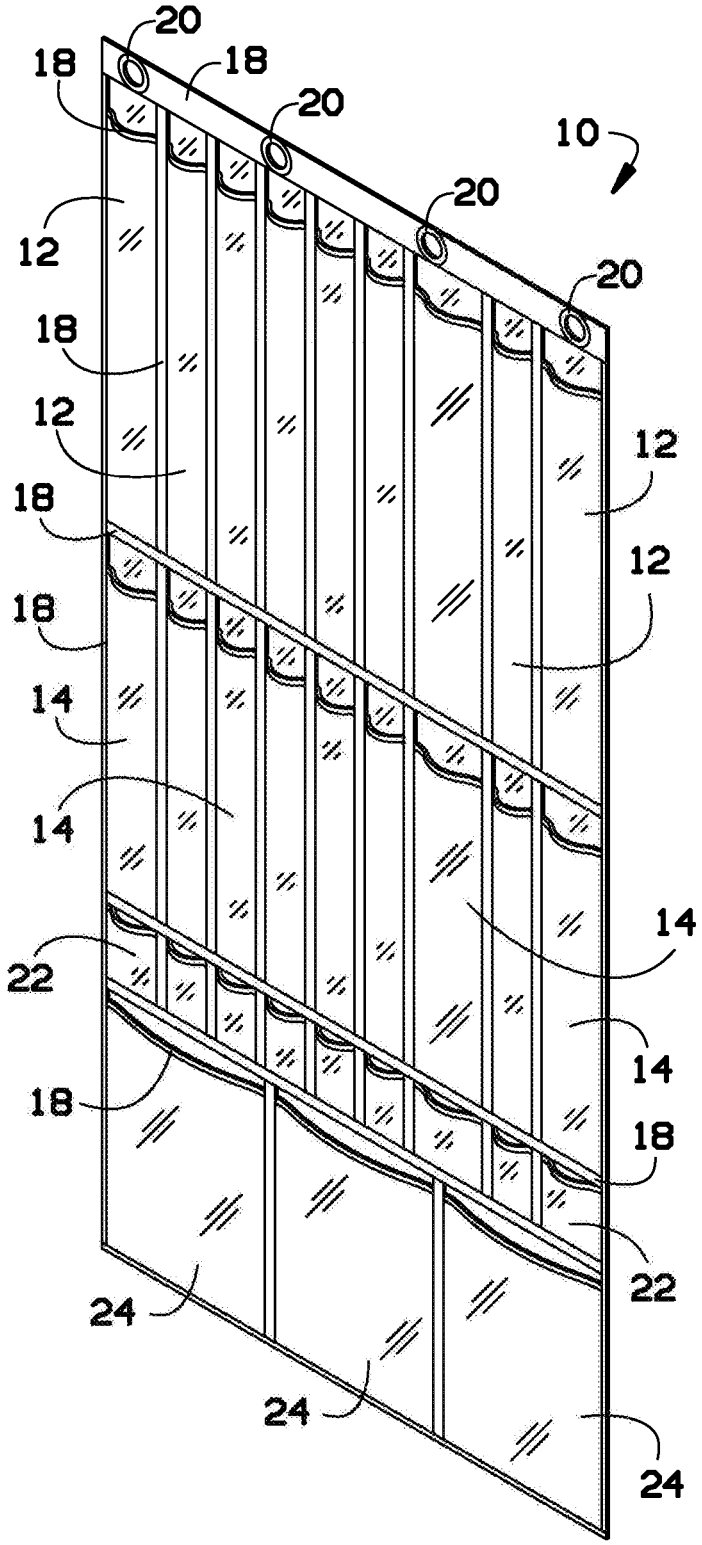
FIG. 4 is a perspective view of a storage device according to an alternate embodiment of the present invention.

The rows of pockets 12, 14, 16 may be arranged in various positions. For example, the row of pockets 12 may be located at the top of the storage device 10, the row of pockets 16 may be located below the row of pockets 12, and the row of pockets 14 may be located below the row of pockets 16. In an alternate embodiment of the present invention, as shown in FIG. 4, a fourth row of pockets 22 may be formed in the storage device 10. This fourth row of pockets 22 may be formed smaller than the other pockets 12, 14, 16 for storing small craft items. For example, the row of pockets 22 may include from about 8 to about 12 pockets, each pocket having a width between about 1 to about 3 inches and a height from about 2 to about 4 inches.

In one embodiment of the present invention, the widths of the pockets 22 in the row of pockets 22 may match the widths of the below and/or above adjacent row of pockets 22. The row of pockets 22 may be situated between any of the above described rows of pockets 12, 14, 16. As shown in FIG. 4, the row of pockets 22 may be situated between the row of pockets 14 and a row of large pockets 24.

Figure 6:
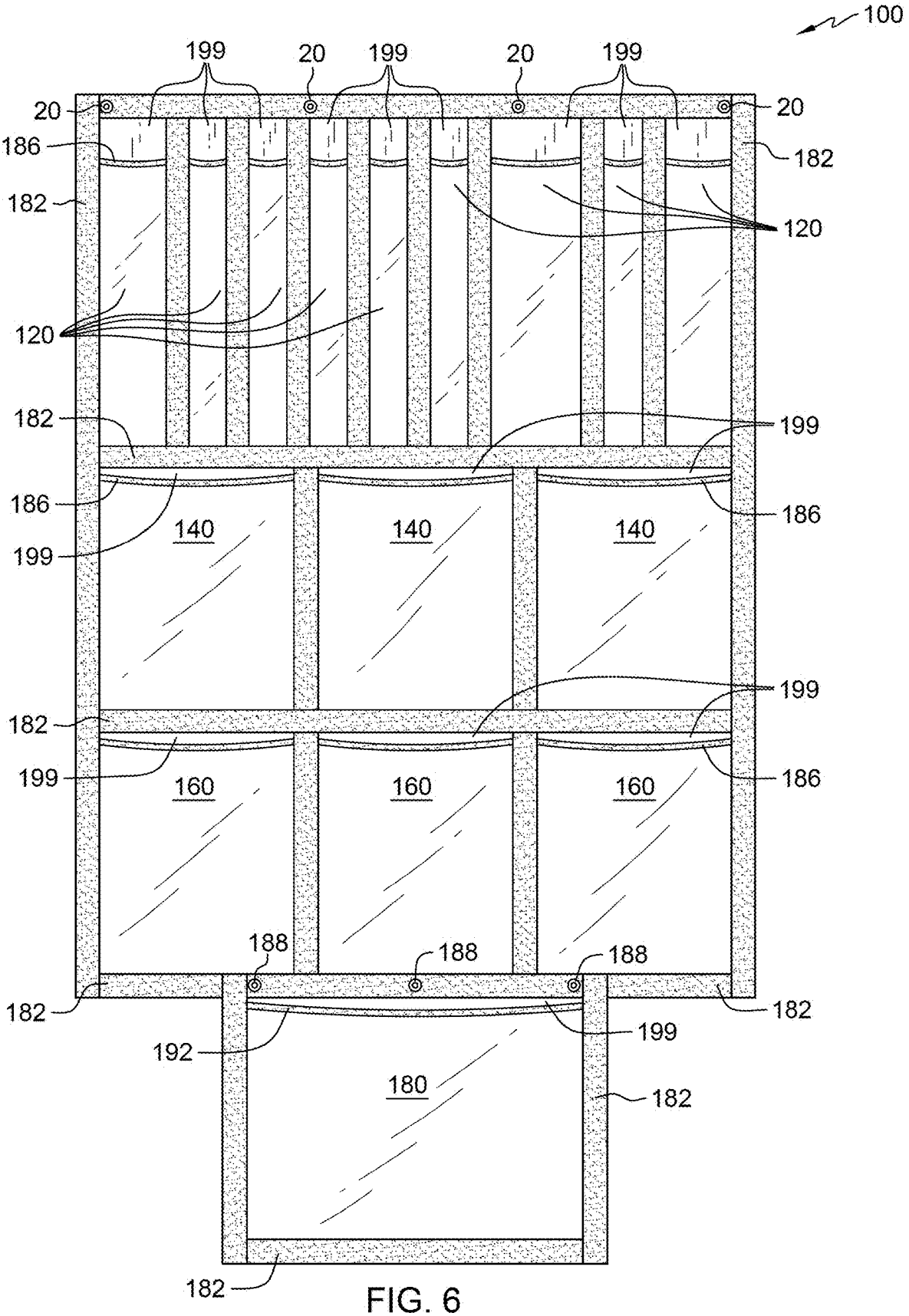
FIG. 6 is a front plan view of an embodiment of the storage device of the invention.

FIG. 6 presents an embodiment of the inventive storage device 100 that includes a detachable accessory pouch 180. Storage device 100 includes a plurality of pockets 120, 140 and 160 formed preferably of a transparent or a translucent material attached at pocket boundaries to a backing panel or sheet 199. The pocket material may be, for example, a clear heavy duty vinyl. The pockets 120, 140, 160 may be separated by a 1-inch trim 182, preferably on all pocket boundaries as shown. For example, the leftmost pocket 120 comprises clear vinyl with a pocket trim 186 at an upper boundary of the pocket. The pocket trim 186 as shown adds strength to the top edge forming a pocket opening. Just above the trim 186 (of left-most pocket 120) is the backing 199 (again, the entire pocket 120 is surrounded by a 1 inch header or trim 182). The 1-inch trim or header 182 may be, for example, black, clear or a variety of colors, without deviating from the scope and spirit of the invention.

A plurality of grommets 20 are included at one end of the storage device 10, as shown (preferably, the upper end as shown in FIG. 6). As shown, storage device 10 includes four (4) substantially equally-spaced grommets 20 along an edge of the storage device 10 (preferably the top edge as shown). The grommets 20 may be used for easy installation of the storage device 10 in reliance upon the grommets, for example, on 4 hooks on a back of a door. For that matter, the grommets 20 may allow for portability of the storage device 10. In an alternate embodiment, over-the-door hooks may be either attached directly to the storage device 10 or may be used to provide a hook for the grommets 20. Preferably, the grommets 20 are ½ inch brass grommets.

Similarly, three (3) grommets 100 may be disposed along a bottom edge of the storage device 100 (see FIG. 6) to support securing an accessory pouch 180 to the storage device 100, as shown. The accessory pouch 180 is formed by attaching the clear plastic vinyl defining pouch 180 to a backing 199. The backing 199 may be seen through the clear vinyl pocket 180. The pocket 180 includes an approximately ½ in. pouch trim 192; one (1) inch headers 182 surround the pocket 180 on the bottom, left and rights sides (FIG. 6).

The storage devices of this invention preferably are from about 20 to about 40 inches wide, but typically about 25 to 30, for example, 28 inches or 28 and ¼ inch wide and about 35 to about 55 inches high, typically about 50-60 inches high and preferably 41.5 inches high (including the pocket 180 and 1 inch trims 182 as shown). With the accessory pouch 180, the FIG. 6 embodiment is 54.5 inches, where the pouch is centered such that the width is 16 inches, which is about 18 inches with the two (2) 1-inch trims 182.

The first row of pockets 120 (elongated pockets 120) each may include from about 5 to about 15 pockets. Typically, the first row of pockets 120 will have 8 to about 10 pockets. Storage device 100 (FIG. 6) includes 9 separate pockets 120, from the left to right facing the page, with the following widths: 2⅜ in.; 1⅜ in.; 1⅜ in.; 1⅜ in.; 1⅜ in.; 1⅜ in.; 3⅞ in.; 1⅜ in.; and 2⅜ in. The pockets 120 are separated by 1 inch headers 182 and preferably have depths of about between 11 and 15 inches, where in the embodiment shown the depths are about thirteen and one half (13½) inches (without the headers 182). The separations (the 1 in. headers 182) may be made of the same materials as the trim (or the vinyl pocket material). The top edge of each pocket includes a pocket trim 186.

The second and third rows of pockets 140, 160 are substantially equal in size in the FIG. 6 embodiment. Generally, the pockets 140, 160 display depths from about 7 to about 12 inches, preferably 9 to 11 inches, where in the embodiment as shown the depths are 10 inches (11 inches total for each row with the 1 inch headers 182). And while the second and third rows of pockets 140, 160 may have various widths, ranging, for example, from about 6 inches to about 10 inches, preferably 7 to 9 inches inches wide, the pockets 140, 160 as shown are 8 inches wide, where each includes at least one 1-inch header (as explained, the pockets 140, 160 are separated from each other by 1 in. trims 182, which act as separation strips).

The accessory pouch 180 may be about 12 to 20 inches wide and about 8 to 16 inches in depth, preferably 14 to 18 inches wide and about 10 to 14 inches in depth, where the embodiment shown is 16 inches wide and 12 inches in depth (or 18 inches wide with the trim 182 and 13 inches in depth with the trim 182. That is, the pocket 180 includes a 1-inch trim 182 at its open edge, where a ¼ inch accessory pouch trim 192 is provided at the top edge of the pouch 180. The ¼ inch accessory pouch trim is affixed to the upper edge of the material comprising pocket 180, where its bottom, left and right edges attached to the backing 199 to form the pockets (enclosures).

The accessory pouch may be described as a clear pouch, and preferably has closure means such as Velcro or a zipper to close the pouch; on Velcro portion is attached to the vinyl backing and one Velcro complementary portion is arranged proximate to or replaces the pocket trim 186. The accessory pouch 180 is intended to be used as a detachable "grab and go" holder. Users may attach and rely upon the additional accessory pouch to bring their current knitting projects with them while they travel (for example, to knit while on a plane, train or automobile, etc. Of course, the 10 by 12 inch accessory pouch holds the knitting supplies for a particular project. The pockets (120, 140, 160) typically hold circular needles. There are many different sized needles with differing lengths and purposes, which the innovative storage devices perfectly manages.

The grommets 188 are ½ inch brass and be equally spaced, as shown, but the invention is not limited to grommets 188 for attaching the accessory pouch 182; other means for attaching an accessory pouch to the storage device 100. The accessory pouch 180 may be attached in reliance upon only 3 grommets 188, as shown. For that matter, the bottom 1-inch trim 182 on the accessory pouch 180 is optional, as there is little need to reinforce the bottom edge of same (as shown in FIG. 6).

In some embodiments, the widths of the pockets in a row of pockets may match widths of the below adjacent row of pockets and/or above adjacent row of pockets. For example, an additional row of pockets may be situated between any of the above described rows of pockets 120, 140, and 160 (not shown in FIG. 6).

It should be understood, of course, that the foregoing relates to exemplary embodiments of the invention and that modifications may be made without departing from the spirit and scope of the invention as set forth in the following claims.

What is claimed is:

1. A storage device for storing and displaying knitting supplies, comprising:

a vinyl backing;

first, second and third rows of pockets formed from planar, substantially rectangular portions of pocket material attached to the vinyl backing at 3 of 4 edges of the planar, substantially rectangular portions thereby forming an opening at a fourth edge that is not attached to the vinyl backing;

wherein the first row of pockets provides for storing and displaying knitting needles; and wherein the second and third rows of pockets are substantially similar and provide for storing and displaying knitting materials;

an edge trim arranged at respective edges of the planar, substantially rectangular portions of the first, second and third rows of pockets, which edge trim separates the pockets, a plurality of grommets arranged in the trim proximate a top edge of the vinyl backing; and an accessory pouch detachably attached to edge trim proximate a bottom edge of the third row of pockets;

wherein the planar, substantially rectangular portions of pocket material attached to the vinyl backing at 3 of 4 edges are transparent or translucent; and wherein the planar, substantially rectangular portions of pocket material include a pocket trim located at the fourth edge of the 4 edges of the pocket material, which fourth edge of the 4 edges is not attached to the vinyl backing, to operate as a pocket opening, and to support knitting needles stored and displayed therein.

2. The storage device of claim 1, wherein the accessory pouch is attached with a means for attaching.

3. The storage device of claim 1, wherein the means for attaching comprises grommets to which the accessory pouch attaches.

4. The storage device of claim 1, wherein the pockets of the first row of pockets include from about 8 to about 10 pockets.

5. The storage device of claim 4, wherein the pockets of the first row of pockets includes 9 pockets.

6. The storage device of claim 1, wherein the pockets of the first row of pockets are about 1 inch to about 4 inches wide and from about 10 to about 16 in depth.

7. The storage device of claim 1, wherein the pockets of the first row of pockets are any of 2.75 inches, 1.5 inches and 3.75 inches in width and 13.5 inches in depth.

8. The storage device of claim 1, wherein the pockets of the second and third row of pockets are about 8 inches to about 12 inches in depth and about 6 inches to 10 inches in width.

9. The storage device of claim 8, wherein the pockets of the second and third row of pockets are about 10 inches in depth and about 8 inches in width.

10. The storage device of claim 1, wherein the accessory pouch is between about 10 inches and 14 inches in depth and about 10 inches to 18 inches in width.

11. The storage device of claim 10, wherein the accessory pouch is about 12 inches and 16 inches in width.

12. The storage device of claim 11, wherein the planar material comprising the accessory pouch is clear plastic or vinyl and includes Velcro or a zipper to close the accessory pouch.

13. The storage device of claim 1, wherein the plurality of grommets includes four grommets equally spaced along the top edge of the storage device.

14. The storage device of claim 1, further comprising trim material separating the pockets and separating the pockets from an accessory pouch.

15. The storage device of claim 14, wherein a bottom edge of the accessory pouch is fortified by a 1-inch vinyl band or an EVA band.

16. A storage device for storing and displaying knitting supplies, consisting essentially of:

multiple rows of transparent pockets including at least a first row of elongated pockets for storing and displaying knitting needles, a second row of elongated pockets for storing and displaying knitting needles positioned below the first row of elongated pockets, and a first row of large pockets for storing and displaying knitting materials positioned below the second row of elongated pockets;

a top edge and a bottom edge of the storage device formed with top and bottom device trims comprising a trim material;

a plurality of grommets located along the top and bottom device trims comprising the top edge and the bottom edge of the storage device providing capabilities to easily install and to secure the storage device, respectively; and an accessory pouch attached to a binding or trim material that binds the accessory pouch to a lowest row;

wherein the first row of elongated pockets and the second row of elongated pockets each include from about 8 to about 10 elongated pockets;

wherein each of the elongated pockets is configured with a pocket edge trim on an exterior edge of a transparent or translucent material forming the elongated pockets, separating the pockets and providing a capability to support knitting needles stored and displayed therein;

wherein the first row of elongated pockets and the second row of elongated pockets are independently from about 1 to 3 inches wide and from about 16 to about 20 inches high;

wherein the first row of large pockets includes three equally sized pockets; and wherein the accessory pouch is about 12 inches in depth and 16 inches in width.

* * * * *